United States Patent [19]

Ohchi et al.

[11] Patent Number: 4,538,533

[45] Date of Patent: Sep. 3, 1985

[54] WORKPIECE HOLDING-DOWN DEVICE FOR A SEWING MACHINE

[75] Inventors: Torao Ohchi; Hideo Yasui, both of Tokyo, Japan

[73] Assignee: Tokyo Juki Industrial Co., Ltd., Tokyo, Japan

[21] Appl. No.: 535,858

[22] Filed: Sep. 26, 1983

[30] Foreign Application Priority Data

Sep. 30, 1982 [JP] Japan ..... 57-171588
Jul. 22, 1983 [JP] Japan ..... 58-113743[U]

[51] Int. Cl.[3] ..... D05B 69/28; D05B 29/02

[52] U.S. Cl. ..... 112/239; 112/275; 112/284

[58] Field of Search ..... 112/239, 235, 121.11, 112/158 E, 271, 275, 220, 284

[56] References Cited

U.S. PATENT DOCUMENTS

| | | | |
|---|---|---|---|
| 2,970,557 | 2/1961 | Schwab et al. | 112/239 X |
| 3,230,915 | 1/1966 | Becker et al. | 112/239 |
| 3,298,341 | 1/1967 | Bonis | 112/239 X |
| 3,601,072 | 8/1971 | Husted | 112/239 X |
| 4,214,540 | 7/1980 | Cook | 112/235 |

*Primary Examiner*—Werner H. Schroeder
*Assistant Examiner*—Andrew M. Falik
*Attorney, Agent, or Firm*—Wolf, Greenfield & Sacks

[57] ABSTRACT

A workpiece holding-down device for a sewing machine comprises a spring-loaded presser bar and foot assembly supported in the framework of said sewing machine, a drive mechanism for moving said assembly vertically, and a control circuit for controlling the movement of said presser bar. The foot assembly includes signal means for positioning the presser bar and foot assembly in a controlled position in response to the actuation of an operation member or stored information.

4 Claims, 8 Drawing Figures

WORKPIECE HOLDING-DOWN DEVICE FOR A SEWING MACHINE

BACKGROUND OF THE INVENTION

This invention generally relates to a workpiece holding-down device for a sewing machine and more particularly, to a workpiece holding-down device for a sewing machine which can automatically position the presser foot in a predetermined or desired position in response to the actuation of an operator's operation member such as the pedal or in accordance with a stored information.

In a sewing machine, it has been generally known that a workpiece to be processed is held against the table of the sewing machine by the presser foot under a suitable pressure.

In one of the conventional sewing machines, the presser foot is capable of moving between two predetermined positions, that is, the workpiece holding-down position in which the workpiece is pinched between the presser foot and the sewing machine table and the workpiece release position in which the presser foot is positioned above the workpiece on the sewing machine table, but can not be held in any intermediate position between the workpiece holding-down and release positions. Thus, the position of the presser foot can not be adjusted in accordance with the thickness of the workpiece to be processed. Therefore, in order to firmly or properly hold a workpiece having a very thin thickness down against the sewing machine table, a skilled operator is required. For example, when a new workpiece is manually fed to and held at the sewing area on the table of a sewing machine, if the distance between the presser foot in the workpiece release position and the workpiece is excessively great, the operator encounters difficulty in guessing which area or part of the workpiece will be engaged by the descending presser foot. Furthermore, the workpiece tends to slip off the sewing area on the sewing machine table during the time space from the time when the presser foot begins to descend to the time when the presser foot abuts against the upper surface of the workpiece. In order to solve the difficulty, the presser foot has to be moved upwardly and downwardly many times until the workpiece can be precisely set in a predetermined proper sewing position resulting in quite low operation efficiency.

SUMMARY OF THE INVENTION

Therefore, a principal object of the present invention is to provide a novel and improved workpiece holding-down device for a sewing machine which can effectively eliminate the disadvantages inherent in the conventional workpiece holding-down device for a sewing machine and which can automatically position the presser foot in any desired position.

Another object of the present invention is to provide a workpiece holding-down device for a sewing machine which can control the position of the presser foot in conformity with the thickness of a workpiece to be processed to thereby ensure proper sewing operation.

Another object of the present invention is to provide a workpiece holding-down device for a sewing machine which can set the presser foot in any desired position by the operation of an operator's operation member for proper sewing operation.

Another object of the present invention is to provide a workpiece holding-down device for a sewing machine which can position the presser foot in a controlled position in accordance with a stored program information.

Another object of the present invention is to provide a workpiece holding-down device for a sewing machine in which the distance of the presser foot is raised at a corner of a workpiece to be processed during a sewing operation or after the sewing operation can be suitably preset whereby the turning of the workpiece during the sewing operation and the removal of the workpiece after the sewing operation can be accelerated.

Another object of the present invention is to provide a safe workpiece holding-down device for a sewing machine in which the application of any excessive load to the drive mechanism for the presser foot is prevented in a position adjacent to the uppermost position of the presser foot.

In order to attain the objects of the present invention referred to above, the workpiece holding-down device for a sewing machine according to the present invention comprises a vertically movable presser bar and foot assembly, a drive mechanism for the presser bar and foot assembly operatively connected to the assembly for driving the assembly for upward and downward movement and a control mechanism for controlling the drive mechanism so as to position the presser bar and foot assembly in a controlled position. In one embodiment of the present invention, the drive mechanism consists of a motor, a partially threaded shaft operatively connected to the motor and linkage operatively connected to the threaded shaft. A cylinder unit can be employed in place of the motor and threaded shaft.

The control mechanism controls the drive mechanism so that the presser bar and foot assembly can be positioned in the position corresponding to the displacement amount of an operation member or in accordance with height information stored in a memory.

The above and other objects and attendant advantages of the present invention will be more readily apparent to those skilled in the art from a reading of the following detailed description in conjunction with the accompanying drawings which show the preferred embodiment of the invention for illustration purpose only, but not for limiting the scope of the same in any way.

DESCRIPTION OF THE PREFERRED EMBODIMENT OF THE INVENTION

Figure 1:
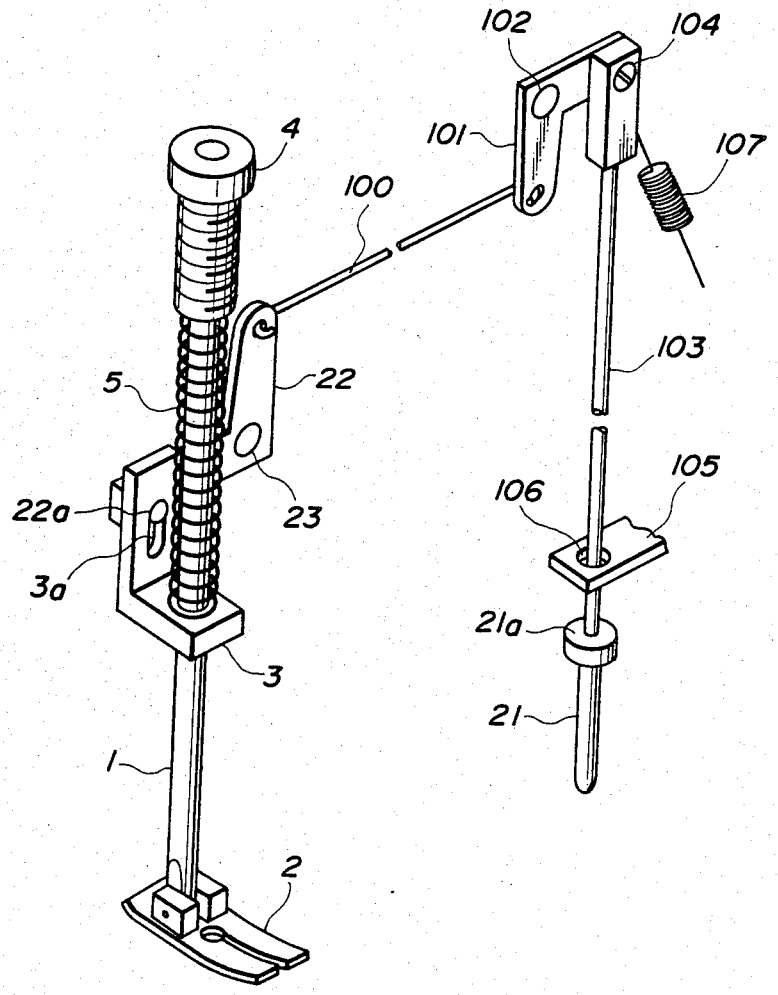
FIG. 1 is a perspective view of the presser foot and bar assembly and the linkage operatively connected to the assembly in the preferred embodiment of the workpiece holding-down device of the invention.

Referring now to the accompanying drawings and more particularly, FIG. 1 thereof in which the presser bar and foot assembly which is conventionally mounted in a sewing machine (not shown) and the linkage operatively connected to the assembly are shown.

The sewing machine with which the workpiece holdingdown device of the invention is employed is a lock stitch sewing machine including the conventional thread cutter and holder and more particularly, a sewing machine of the type which is provided with a conventional microcomputer having a memory in which a plurality of modes corresponding to a plurality of different sewing steps, respectively, are stored as described and illustrated in our pending Japanese Patent Application No. 61579/1981 laid open for publication, Oct. 28, 1982, #175390/82. Such a sewing machine may be so controlled that the number of stitches in one sewing step corresponding to one selected mode can be suitably set, the information stored in the memory is read out in response to the actuation of an operator's operation member (the stepping down on the pedal) to perform the one sewing step, the sewing machine automatically ceases the sewing operation upon the completion of the formation of the set number of stitches and the sewing machine resumes the next sewing operation in response to the next actuation of the operator's operation member to perform the next stitch formation step. The operation of the sewing machine is further so programed that at the completion of each sewing step except for the last sewing step, the sewing machine ceases the operation leaving the needle piercing through the workpiece being processed.

The presser foot and bar assembly is of conventional design and generally comprises a vertical presser bar 1 supported by the framework of the sewing machine (not shown) for vertical movement, a substantially horizontal presser foot 2 pivoted to the lower end of the presser bar, an L-shaped presser bar holder 3 secured to the presser bar in a position between the upper and lower ends thereof, a hollow externally threaded holding-down pressure adjusting screw 4 loosely fitted on an upper portion of the presser bar 1 and screwed in the machine framework for vertical movement along the presser bar and a coil spring 5 disposed about the presser bar 1 in compressed condition between the holder 3 and adjusting screw 4. The presser foot 2 is adapted to hold a workpiece being processed against the machine table (not shown) with a suitable pressure.

Figure 2:
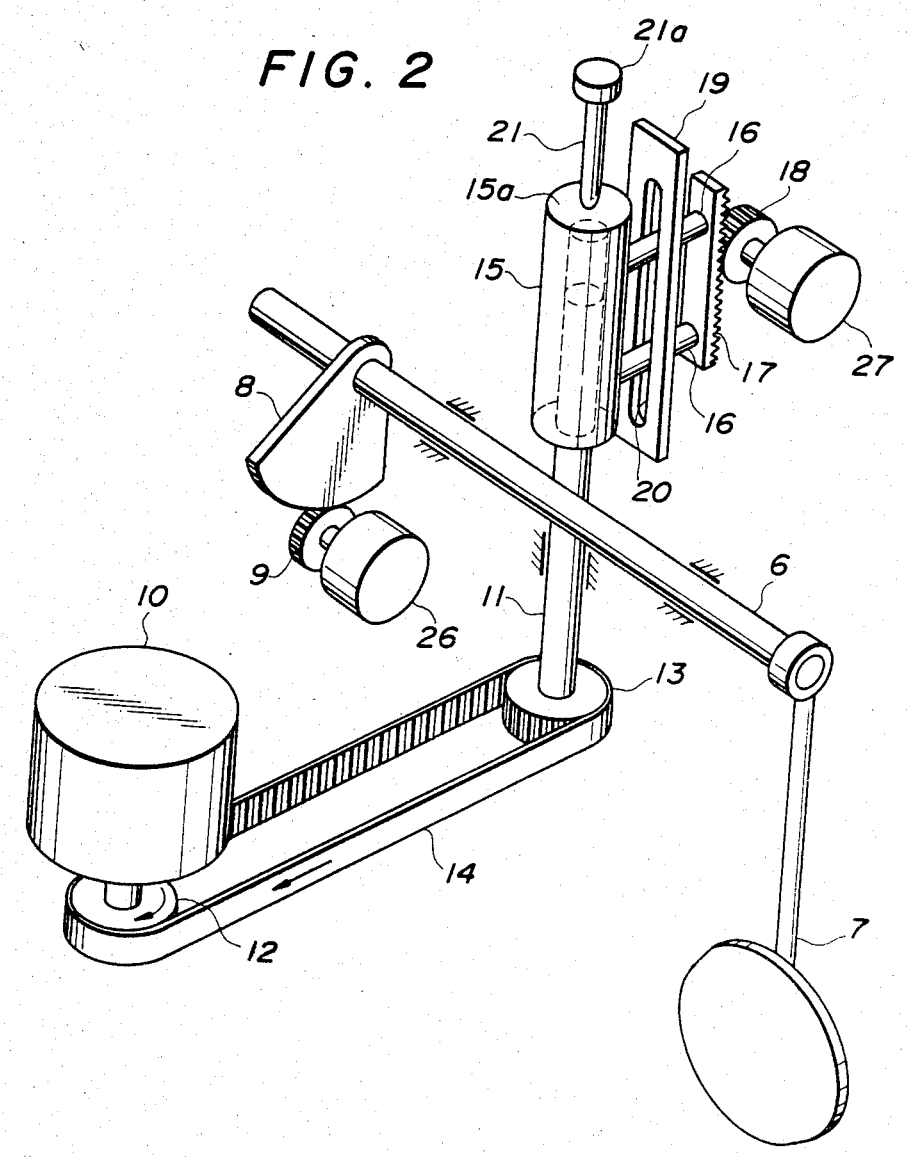
FIG. 2 is a perspective view of a first embodiment of the drive mechanism and the control mechanism of the workpiece holding-down device.
Figure 3:
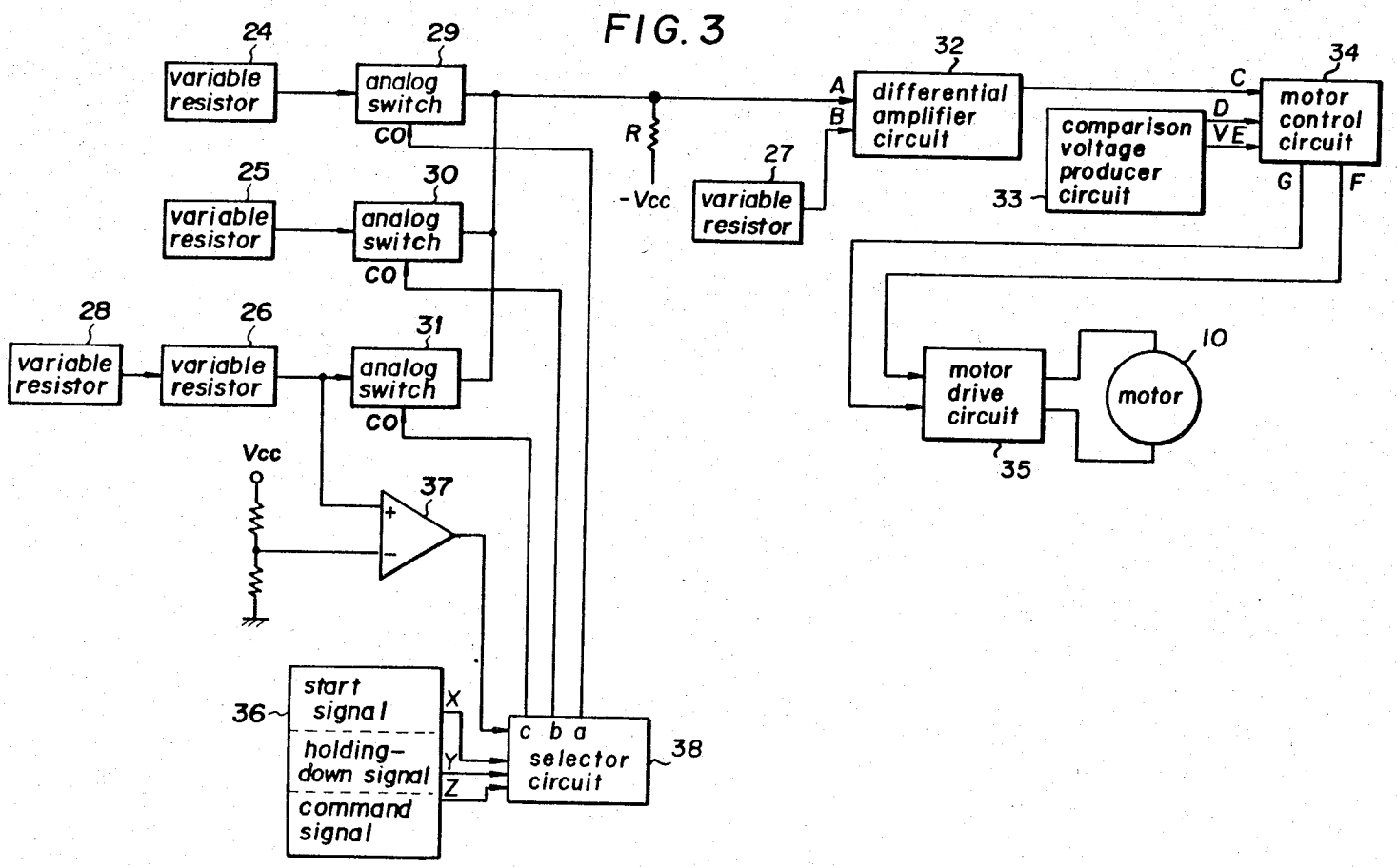
FIG. 3 is a schematic block diagram of the control mechanism.

FIG. 2 fragmentarily shows the drive mechanism for the presser bar and foot assembly and the drive mechanism is positioned below the machine bed (not shown). The drive mechanism includes a horizontal lever shaft 6 suitably supported in the machine framework (not shown) extending in the workpiece feed direction for limited rotational movement about the longitudinal axis thereof. The lever shaft is normally subjected to a force in the clockwise direction by a resilient member (not shown). Secured to the front end of the lever shaft 6 which faces the operator is the upper end of a knee-operated lever 7 and a sector gear 8 is secured to the other or rear end of the lever shaft 6. Reference numeral 9 denotes a pinion which meshes the sector gear 8. Reference numeral 10 denotes a reversible motor as the drive source of the drive mechanism. A vertical partially threaded shaft 11 is journalled in a pedestal 39 (FIG. 6) secured to the machine framework and operatively connected to the motor 10 through sprockets 12, 13 and a timing belt 14 to be rotated by the motor. The portion of the shaft 11 extending above the pedestal 39 is externally formed with male threads 11*a*. An internally threaded tubular member 15 is in threaded engagement with the male threads 11*a* the vertical shaft 11 and a pair of spaced parallel guide pins 16 extend horizontally and outwardly from the tubular member 15. A vertical rack 17 is secured to the ends of the guide pins 16 remote from the tubular member 15 and has the axis parallel to those of the shaft 11 and tubular member 15. Reference numeral 18 denotes a pinion which is in threaded engagement with the teeth on the rack 17. A vertical guide plate 19 is secured to the machine framework between the tubular member 15 and rack 17 in parallel and spaced relationship to them and formed with a vertically elongaged slot 20 through which the guide pins 16 extend loosely so that the tubular member 15 is prevented from rotating about the shaft 11.

Figure 6:
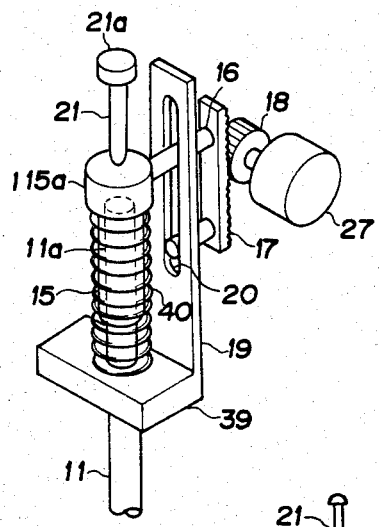
Fig. 6 is a perspective view of portion of FIG. 2 showing the presser foot manipulation means of the workpiece holding-device.

A pusher bar 21 is conventionally supported on the framework of such as an oil pan or the like for vertical movement. The downward movement of the pusher bar 21 by its own gravity arrested when the flange 21*a* at the top thereof abuts against the upper surface of the machine framework. The lower end portion of the pusher bar 21 is normally positioned below the undersurface of the machine framework with the pointed lower end face thereof slightly spaced from the upper surface of 15*a* of the tubular member 15. In the embodiment of FIG. 6, a resilient tubular member 40 is disposed about the tubular member 15 and compressed between the flange 115*a* thereof and the pedestal 39 on the machine framework to normally urge the tubular member 15 upwardly. The pusher bar 21 is connected through a linkage which will be described hereinbelow to the presser bar 2. The linkage includes a pusher lever 22 which is provided at one end with a pin 22*a* extending freely through the slot 3*a* formed in the vertical portion of the presser bar holder 3. The pusher lever 22 is pivoted to the machine framework by means of a stub shaft 23 and connected at the other end to one end of an intermediate lever 101 through a horizontal rod 100. The intermediate lever 101 is in turn pivoted at the other end to the machine framework by means of a stub shaft 102. A vertical interlocking rod 103 is pivoted at one or the upper end to the other end of the intermediate lever 101 by means of a pivot pin 104 and the lower end of the interlocking rod 103 extends through the through hole 106 in a guide 105 secured to the machine framework to a position adjacent to the flange 21*a* on the pusher bar 21. A coil spring 107 extends between and is anchored at the opposite ends to the intermediate lever 102 and machine framework to normally urge the lever 102 in the clockwise direction as seen in FIG. 1. The coil spring 107 has a very small spring constant. The size of the through hole 106 in the guide 105 is so selected that the lever 102 is allowed to pivot, but the lower or free end of the interlocking rod 103 is prevented from coming off the area defined by the upper surface of the flange 21*a* of the pusher bar 21.

In the arrangement described hereinabove, when the pusher bar 21 moves upwardly, the intermediate lever 101 pivots about the stub shaft 102 in the counter-clockwise direction as seen in FIG. 1 and thus, the pusher lever 22 pivots about the stub shaft 23 in the clockwise direction as seen in FIG. 1. On the other hand, when the pusher bar 21 moves downwardly the pusher bar and foot assembly moves downwardly.

In order to control the movement distance of the presser bar and foot assembly, the drive mechanism is controlled by a control mechanism as will be described hereinbelow. The control mechanism generally includes substantially stationary variable resistors 24 and 25 which are adapted to produce voltage when applied thereto the voltage from a common power source. The resistor 25 produces a voltage higher than that produced by the resistor 24. Referance numerals 26, 27 and 28 denote variable resistors (potentiometers). The variable resistor 26 is adapted to produce a voltage (push-up signal) which varies as the pinion 9 changes its angular position in the rotation thereof, the variable resistor 27 is adapted to produce a voltage (position signal) which varies as the pinion 18 changes its angular position in the rotation thereof and the variable resistor 28 is adapted to produce a voltage (correction signal) which varies as a manually operated dial (not shown) changes its angular position in the rotation thereof.

Reference numerals 29, 30 and 31 denote analog switches in each of which the input and output are turned on when the control terminal CO receives a low level signal L. A differential amplifier circuit 32 amplifies the difference between voltages A and B at the inputs and assuming that the amplification ratio is $\beta$, then the output voltage C is $\beta\cdot(A-B)$. A comparison voltage producer circuit 33 generates different voltages at the outputs D and E ($D>L$) of the circuit 33 when the circuit is applied thereto the voltage from the power source. A motor control circuit 34 compares the voltage C with the voltages D and E to produce voltages at the outputs F and G as thereof follows:

| Condition | Output F | Output G |
|---|---|---|
| $C > D$ | H | L |
| $D > C > E$ | L | L |
| $E > C$ | L | H |

A motor drive circuit 35 rotates the motor 10 in the clockwise direction (the arrow direction in FIG. 2) when the output F from the motor control circuit 34 is H, rotates the motor 10 in the counter-clockwise direction when the output G from the motor control circuit 34 is H and stops the motor 10 when the outputs F and G from the motor control circuit 34 are L. A sewing machine control circuit 36 in the illustrated embodiment is adapted to control the sewing mechanism and other accessary mechanisms of the sewing machine in accordance with a program assigned to a selected sewing mode. The sewing machine control circuit 36 produces a start signal X when the pedal is stepped down, produces a holding-down signal Y at the completion of each sewing step except for the last sewing step in each sewing mode and produces a command signal Z at the completion of the last sewing step in each sewing mode to thereby operate the wiper or thread cutter and holder (not shown). A comparator 37 produces a signal H when voltage at the plus input becomes higher than that at the minus input. A selector circuit 38 determines which analog switch should be turned on depending upon the operation condition of the sewing machine, produces the outputs H at the terminals a, b and c when the start signal X is produced, produces the output L at only the terminal a when the holding-down signal Y is produced after the producing of the start signal Y and before the producing of the command signal Z and produces the output L at only the terminal b when the holding-down signal Y is produced after the producing of the command signal Z and before the producing of the start signal X. Furthermore, when the singal or output H is produced in the comparator 37, the output L is produced only at the terminal c even when the output at the terminal a or b of the selector circuit 38 is L. And R denotes a resistance interposed between the analog switch 29 and differential amplifier circuit 32.

With the above-mentioned construction and arrangement of the components of the workpiece holding-down device of the invention, the device operates as follows:

When the motor 10 rotates in the clockwise direction as seen in FIGS. 1 and 2, the partially threaded shaft 11 is rotated in the same direction as the motor by the motor through the sprockets 12, the timing belt 14 and the sprocket 12, but the tubular member 15 is prevented from rotating about the shaft 11 by the fact that the guide pins 16 are received in the slot 20 in the guide plate 19 and thus, the tubular member 15 moves upwardly along the partially threaded shaft 11 as the shaft 11 rotates. On the other hand, when the motor 10 rotates in the opposite or counter-clockwise direction as seen in FIGS. 1 and 2, the tubular member 15 moves downwardly along the shaft 11. The tubular member 15 is normally in its predetermined lowered position wherein the presser bar and foot assembly is held in its lowered position with the presser foot 2 in contact with the upper surface of the sewing machine bed under the force of the holding-down spring 5. When the tubular member 15 moves upwardly with the presser bar and foot assembly held in this position, the pusher bar 21 is pushed upwardly by the upwardly moving tubular member 12. As the pusher bar 21 is pushed upwardly, the pusher lever 22 pivots about the stub shaft 23 in the clockwise direction to push the presser bar and foot assembly upwardly against the force of the holding-down spring 5 and thus, the presser bar and foot assembly and accordingly, the presser foot 2 thereof moves upwardly by the distance corresponding to the upward movement amount of the tubular member 15. Therefore, when the rotation amount of the motor 10 is suitably controlled, the distance of the presser foot 2 above the upper surface of the sewing machine bed can be suitably varied.

As the tubular member 15 moves upwardly, the variable resistor 27 produces a voltage corresponding to the upward movement amount of the member 15. And as the knee-operated lever 7 rotates in the counter-clockwise direction, the variable resistor 26 produces a voltage corresponding to the rotation amount of the lever 7.

The rotation of the motor 10 is controlled as follows:

When a sewing mode corresponding to a particular sewing pattern comprising a plurality of sewing steps is selected, the number of stitches for each sewing step is set and the pedal is then stepped down, the sewing machine control circuit 36 produces the start signal Z whereupon the analog switches 29, 30 and 31 are turned off and the input A of the differential amplifier circuit 32 is applied a minus power source voltage thereto whereby the voltage at the output C of the differential amplifier circuit 32 becomes lower than that at the output E of the comparison voltage producer circuit 33 and the voltage at the output G of the motor control circuit 34 becomes H and thus, as the motor 10 rotates in the counter-clockwise direction. As the motor 10 rotates in the counter-clockwise direction, the tubular member 15 moves downwardly and the presser bar and foot assembly also moves downwardly whereby the output voltage of the variable resistor 27 drops gradually until the voltages at the inputs A and B become equal to each other whereupon the voltage at the output C of the differential amplifier circuit 32 becomes zero.

As a result, with respect to voltage value, the relationship $D>C>E$ is established between the inputs of the motor control circuit 34 and the voltages at the outputs F and G of the motor control circuit 34 become L whereby the motor 10 ceases its rotation. Thus, when the pedal is stepped down after the workpiece has been properly placed on the bed of the sewing machine, the presser bar and foot assembly is caused to move downwardly under the force of the holding-down spring 5 until the presser foot 2 firmly hold the workpiece agaisnt the sewing machine bed and substantially at the same time, the sewing machine automatically initiates its stitch forming operation on the workpiece. When the preset number of stitches has been formed on the workpiece, the sewing machine automatically ceases its operation leaving the needle piercing through the workpiece at the last stitch of the preset number of stitches formed on the workpiece and the sewing machine control circuit 36 provides the push-up signal V to raise the presser foot and bar assembly. Since the signal Y is produced after the start signal X has been produced and before the command signal Z is produced, the analog switch 29 turns on in response to the signal Y. As a result, with respect to voltage value, the relationship $A>B$ is established between the inputs of the differential amplifier circuit 32. Thus, the motor 10 continues to rotate in the clockwise direction until the relationship $A=B$ with respect to voltage value is established between the inputs of the circuit 32 whereupon the presser bar and foot assembly rises against the force of the holding-down spring 15 whereby the workpiece can be turned on the sewing machine bed. When the pedal is again stepped down with the presser bar and foot assembly in its raised position, the sewing machine resumes the above-mentioned stitch forming operation.

When a preset number of stitches has been formed on the workpiece in the last sewing step of each mode, the command signal Z is produced and the thread cutter and holder and wiper operate. Thereafter, the holding-down signal Y is produced. Thus, in this case, the analog switch 30 turns on and the input A of the differential amplifier circuit 32 is applied thereto the output voltage of the variable resistor 25. As a result, although the presser bar and foot assembly rises in the manner as described hereinabove, since the output voltage of the variable resistor 25 is higher than the output voltage of the variable resistor 24, the presser foot 2 rises to a position above the sewing machine bed higher than the position of the presser foot in the sewing steps other than the last sewing step.

Thereafter, when the knee-operated lever 7 is rotated in the counter-clockwise direction, the output voltage of the variable resistor 26 increases gradually in proportion to increment in the angular displacement amount of the lever 7 until the value of the output voltage of the resistor 26 becomes higher than that at the minus input of the comparator 37 whereupon the analog switch 31 turns on and the voltage at the input A of the differential amplifier circuit 32 is applied thereto the output voltage of the variable resistor 26. Thus, the rising amount of the presser foot 2 in this case corresponds to the rotation angle of the knee-operated lever 7 whereby when the kneeoperated lever 7 is rotated by its predetermined maximum angular distance, the presser foot 2 rises to its predetermined highest position and on the other hand, when the knee-operated lever 7 is returned to its initial position, the presser foot 2 descends again to hold the workpiece against the upper surface of the sewing machine bed.

Figure 5:
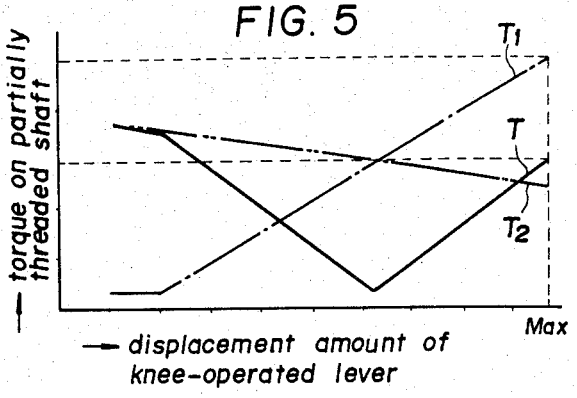
FIG. 5 is a graph showing the relationship between the torque on the partially threaded shaft and the displacement amount of the knee-operated lever of the workpiece holding-down device.

When the presser bar and foot assembly moves upwardly and downwardly, the motor 10 is applied thereto a load by the resilient member 40 formed of resilient plastic. That is, FIG. 5 shows the relationship between the displacement amount of the knee-operated lever 7 and the torque on the partially threaded shaft 11. In FIG. 5, $T_1$ denotes the torque on the shaft 11 applied only by the holding-down spring 5, $T_2$ denotes the torque on the shaft 11 applied by only the resilient member 40 and T denotes the composite torque on the shaft 11 which actually acts on the shaft in the above-mentioned sewing operation. As seen from the relationship shown in FIG. 5, according to the present invention, the maximum torque on the partially threaded shaft 11 is less than that applied to the conventional partially threaded shaft without the resilient member 40 disposed thereon.

Figure 4:
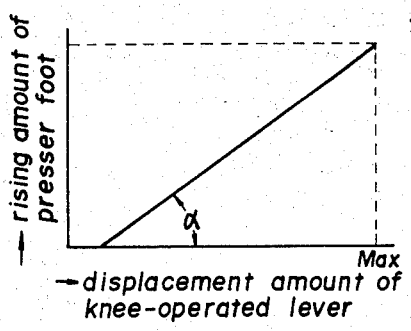
FIG. 4 is a graph showing the relationship between the rising amount of the presser foot and the displacement amount of the knee-operated lever of the workpiece holding down device.

FIG. 4 is a graph showing the relationship between the displacement amount of the knee-operated lever 7 and the rising amount of the presser foot 2. Since the output voltage of the variable resistor 26 varies when the variable resistor 28 is suitably operated, the inclination angle $\alpha$ of the curve varies as the output voltage of the resistor 26 varies. Thus, even when the knee-operated lever 7 is rotated by an equal incremental distance, the rising amount of the presser foot 2 varies.

Figure 7:
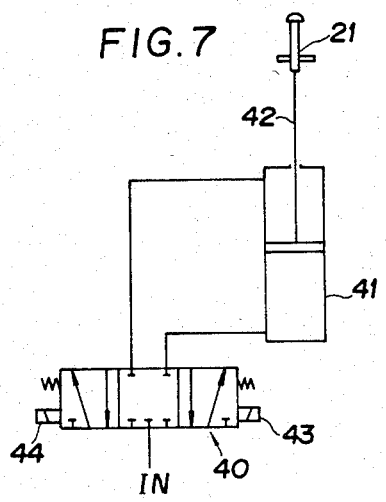
FIG. 7. is a schematic view of another embodiment of the drive mechanism.
Figure 8:
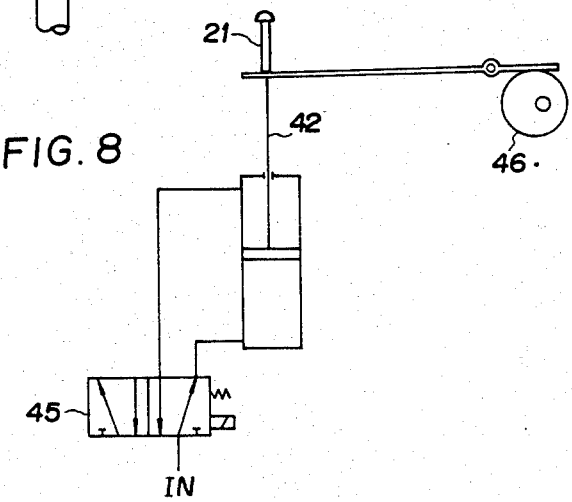
FIG. 8 is a schematic view of a further embodiment of the drive mechanism.

In the foregoing embodiment, although the reversible motor 10 is employed as the drive source, it is also contemplated that the pusher bar 21 is moved upwardly and downwardly by either a linear motor or an air or hydraulic cylinder. When the air or hydraulic cylinder is employed as the drive source, for example, as shown in FIG. 7, the piston assembly 42 of the cylinder 41 is controlled by a control (not shown) through a five-port and three-position electromagnetic valve 40. That is, the piston assembly 42 is operatively connected to the above-mentioned variable resistor 27 whereby when the input voltage relationship $A>B$ is established in the differential amplifier circuit 32, a solenoid 43 is energized to extend the piston assembly 42, when the input voltage relationship $A<B$ is established, a solenoid 44 is energized to retract the piston assembly 42 and when the input voltage relationship $A=B$ is established, the two solenoids 43 and 44 are deenergized to hold the piston assembly 42 in the position as shown in FIG. 7. Alternatively, the piston assembly 42 may be controlled by an eccentric cam 46 through a five-port and two-position electromagnetic valve 45 or electromagnetic solenoid (not shown). The cam 46 is adapted to rotate in accordance with the information relating to the displacement amount of the knee-operated lever or a preset rising amount of the presser foot.

In the foregoing embodiment, although the analog control system has been illustrated, the motor can be controlled by providing a A/D converter behind each of the variable resistors for converting an analog signal into a digital signal or by providing encoders in place of the variable resistors for producing pulse signals to be compared with digital signals or processed by a microcomputer.

In the illustrated embodiment, although the output from the differential amplifier circuit 32 is converted into a digital signal through the comparison voltage producer circuit 33, the output of the differential amplifier circuit 32 can be directly communicated with the motor.

Furthermore, in the illustrated embodiment, although the comparator 37 arrests the rotational movement of the knee-operated lever 7, the movement of the knee-operated lever 7 can be detected by any suitable conventional detector means.

Still furthermore, the above-mentioned workpiece holding-down device can be incorporated into the machine framework, the machine framework and holding-down device can be mounted as a unit on the table of the sewing machine and the workpiece holding-down device can be equally applied to sewing machines other than the lock stitch sewing machine or various sewing machines which do not include the thread cutter and holder and/or sewing mode memory.

While the invention has been particularly shown and described with reference to the preferred embodiment thereof, it will be understood by those skilled in the art that various changes in form and details may be made therein without departing from the spirit and scope of the invention.

What is claimed is:

1. A workpiece holding-down device for a sewing machine comprising a vertically movable workpiece holding-down means including a vertical presser bar and a substantially horizontal presser foot pivoted to the lower end of said pressure bar; a drive mechanism for moving the presser foot; and a control mechanism for controlling said drive mechanism so as to position the presser foot in a controlled position; said drive mechanism comprises a motor, means operatively connected to said motor to convert the rotation of the motor into a linear movement and a linkage operatively connected to said conversion means to transmit said linear movement to said presser bar.

2. The workpiece holding-down device for a sewing machine as set forth in claim 1, in which said conversion means comprises a threaded mechanism.

3. A workpiece holding-down device for a sewing machine comprising:

a vertical presser bar supported in the machine framework of said sewing machine for vertical movement and having a presser foot pivoted to the lower end of said presser bar; p1 a holding-down spring disposed about said presser bar for normally urging the presser foot downwardly;

signal means for producing a push-up signal in response to the operation of an operator's operation member or a program information stored in memory means;

a drive mechanism operable in response to said push-up signal;

a vertically movable tubular member interlocked with said drive mechanism for movement between two predetermined positions;

interlocking means disposed between said tubular member and presser bar for moving said workpiece holding-down means in response to the movement of the tubular member; and a resilient member disposed about said tubular member between the tubular member and said machine framework to normally urge the tubular member upwardly against the force of said holding-down spring.

4. The workpiece holding-down device for a sewing machine as set forth in claim 3, in which said resilient member is formed of resilient plastic.

* * * * *